US009625860B2

(12) United States Patent
Kurita

(10) Patent No.: US 9,625,860 B2
(45) Date of Patent: Apr. 18, 2017

(54) IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Eizo Kurita, Nagaizumi Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/661,893

(22) Filed: Mar. 18, 2015

(65) Prior Publication Data

US 2016/0274507 A1 Sep. 22, 2016

(51) Int. Cl.
*G03G 15/20* (2006.01)
*G03G 15/00* (2006.01)

(52) U.S. Cl.
CPC ..... *G03G 15/2028* (2013.01); *G03G 15/6529* (2013.01); *G03G 15/657* (2013.01); *G03G 2215/00645* (2013.01); *G03G 2215/00945* (2013.01); *G03G 2215/0132* (2013.01)

(58) Field of Classification Search
USPC ..... 399/68
See application file for complete search history.

(56) References Cited

U.S. PATENT DOCUMENTS 5,961,111 A * 10/1999 Kurata ..... G03G 15/6576 271/188
6,324,377 B2 * 11/2001 Ando ..... 271/251
2001/0014235 A1 * 8/2001 Ando ..... G03G 15/6564 399/395
2004/0130093 A1 * 7/2004 Chen ..... B65H 5/06 271/264
2009/0212491 A1 * 8/2009 Noguchi ..... B65H 5/062 271/265.04
2010/0129103 A1 * 5/2010 Ogata ..... G03G 15/1605 399/66
2011/0318081 A1 * 12/2011 Kaneko ..... B41J 13/223 400/611
2012/0027426 A1 * 2/2012 Maruta ..... G03G 15/6564 399/16
2014/0168704 A1 * 6/2014 Hasegawa ..... G06K 15/1823 358/1.15
2014/0169804 A1 * 6/2014 Suzuki ..... G03G 15/0136 399/26
2014/0253655 A1 * 9/2014 Sai ..... B41J 11/007 347/104
2015/0061207 A1 * 3/2015 Iesaki ..... B41J 13/0027 271/3.2
2015/0071667 A1 * 3/2015 Hiroki ..... G03G 15/2014 399/68

* cited by examiner

*Primary Examiner* — Clayton E LaBalle
*Assistant Examiner* — Linda B Smith
(74) *Attorney, Agent, or Firm* — Patterson & Sheridan, LLP

(57) ABSTRACT

An image forming apparatus comprises a first roller, a second roller and a control section. The first roller is arranged on a conveyance path of a sheet. The second roller is arranged downstream side of the first roller in the conveyance path. The control section calculates a deflection amount of the sheet nipped by the first roller and the second roller based on a conveyance speed of the sheet conveyed along the conveyance path, and controls a rotation speed of at least one of the first roller and the second roller based on the calculated deflection amount.

11 Claims, 6 Drawing Sheets

IMAGE FORMING APPARATUS

FIELD

Embodiments described herein relate generally to an image forming apparatus.

BACKGROUND

An image forming apparatus conveys a sheet-like medium (hereinafter collectively referred to as "sheet") such as paper and forms an image on the sheet. The image forming apparatus includes a plurality of rollers arranged along a conveyance path. The plurality of rollers may convey the sheet in a deflected state. The rotation speeds of the plurality of rollers are changed according to the size of the sheet. In this way, the deflection amount of the sheet is adjusted.

However, tolerance exists in the plurality of rollers. Thus, in a case in which the rotation speed of the roller is changed according to the diameter of the roller, the deflection amount after adjustment may be excessive or insufficient. As a result, the conveyance state of the sheet is unstable, which may lead to an image defect on the sheet.

In recent years, the diameter of the roller has become smaller due to the downsizing of apparatus. In this case, the problem of the excess and/or deficiency of the deflection amount, after adjustment, becomes significant. Thus, there is a possibility that image defects on a sheet may occur more frequently.

DETAILED DESCRIPTION

Figure 1:
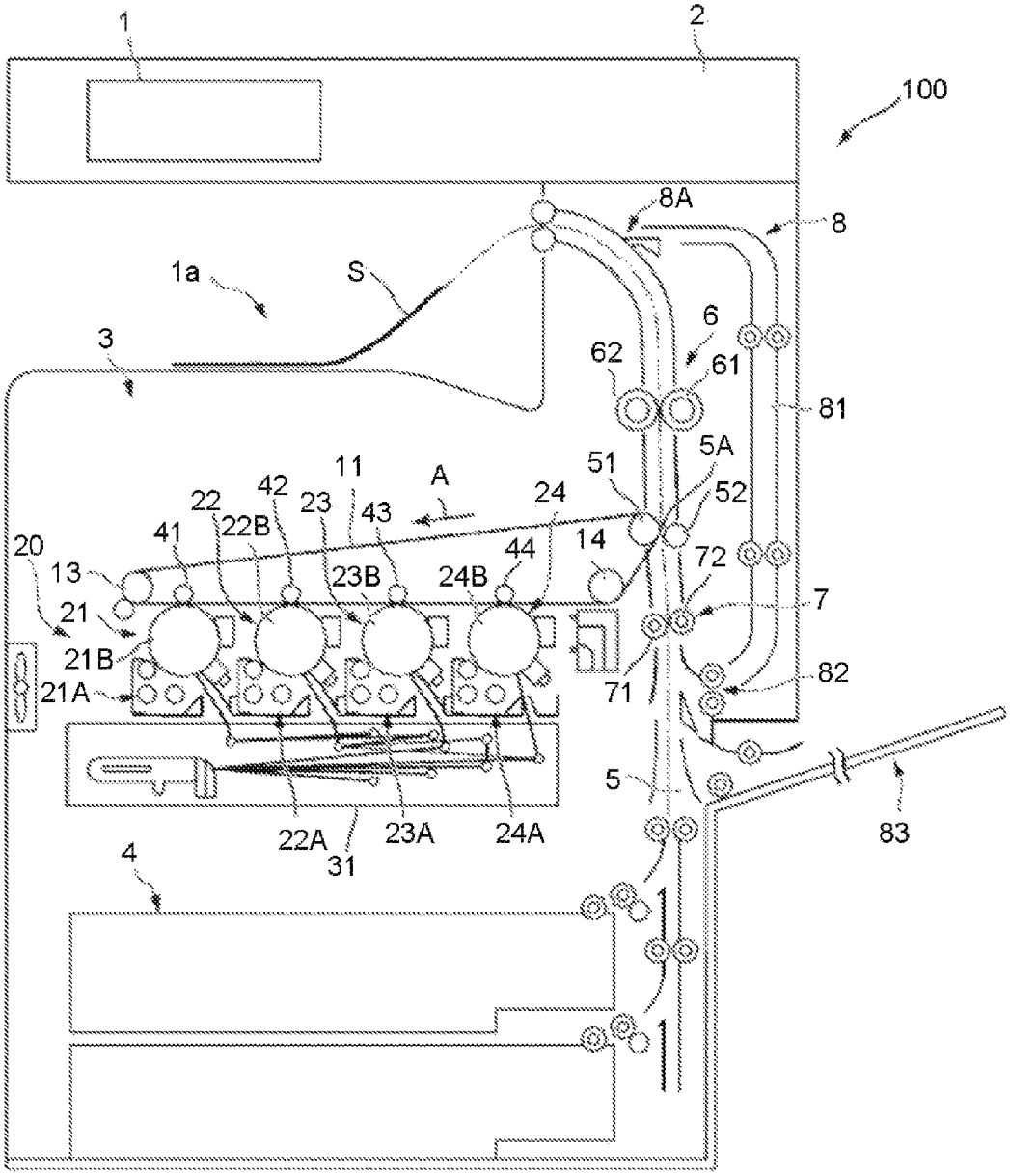
FIG. 1 is a schematic diagram illustrating an image forming apparatus according to one embodiment.

In accordance with one embodiment, an image forming apparatus comprises a first roller, a second roller and a control section. The first roller is arranged on a conveyance path of a sheet. The second roller is arranged downstream of the first roller in the conveyance path. The control section calculates a deflection amount of the sheet nipped by the first roller and the second roller based on a conveyance speed of the sheet conveyed along the conveyance path, and controls a rotation speed of at least one of the first roller and the second roller based on the calculated deflection amount.

Hereinafter, an image forming apparatus 100 according to the embodiment is described with reference to the accompanying drawings. The same components in each figure are applied with the same reference numerals.

FIG. 1 is a schematic diagram illustrating the image forming apparatus 100 according to the embodiment.

As shown in FIG. 1, the image forming apparatus 100 includes a scanner section 2, a printer section 3 and a sheet housing section 4.

The scanner section 2 reads image information of a copy object as brightness and darkness of light and outputs the read image information to the printer section 3.

The printer section 3 transfers an output image (hereinafter referred to as toner image) visualized with developing agent such as toner to a sheet S serving as an image transferred medium, based on the image information output from the scanner section 2. The printer section 3 applies heat and pressure to the sheet S to which the toner image is transferred to fix the toner image on the sheet S.

The sheet housing section 4 respectively stores a plurality of sheets S of different given sizes for each size of the sheet S. The sheet housing section 4 supplies the sheet S one by one to the printer section 3 according to the timing when the toner image is formed in the printer section 3.

A conveyance path 5 is arranged between the sheet housing section 4 and the printer section 3. Conveyance path 5 conveys the sheet S from the sheet housing section 4 to the printer section 3. The conveyance path 5 includes a transfer position 5A. The transfer position 5A is a position where the toner image formed in the printer section 3 is transferred to the sheet S. The sheet S is conveyed through the transfer position 5A towards a fixing device 6.

In the present embodiment, the upstream side with respect to the flow of the sheet S conveyed on the conveyance path 5 is referred to as the upstream side of the conveyance path 5. The downstream side with respect to the flow of the sheet S conveyed on the conveyance path 5 is referred to as the downstream side of the conveyance path 5.

The printer section 3 includes the fixing device 6, a register roller pair 7, a reversal unit 8, an intermediate transfer belt 11 and an image forming section 20.

The intermediate transfer belt 11 is arranged at a given position in the image forming apparatus 100. For example, the intermediate transfer belt 11 is arranged below the fixing device 6 in the vertical direction. For example, the intermediate transfer belt 11, which is an insulating film having a given thickness, is formed in a belt shape. The intermediate transfer belt 11 may also be a thin sheet-like metal having a surface protected with resin, or the like.

A given tension is applied to the intermediate transfer belt 11 by a transfer driving roller 51, a first tension roller 13 and a second tension roller 14. When the transfer driving roller 51 is rotated, any position on the intermediate transfer belt 11 parallel to the axis of the transfer driving roller 51 is moved in a direction indicated by an arrow A. In other words, the belt surface of the intermediate transfer belt 11 is circulated in one direction at a speed equal to the speed of the movement of the outer peripheral surface of the transfer driving roller 51.

The image forming section 20 is positioned where the belt surface of the intermediate transfer belt 11 is substantively moved in a plane, as the given tension is applied.

The image forming section 20 includes image forming units 21, 22, 23 and 24 which are arranged between the first tension roller 13 and the second tension roller 14 at given intervals.

Each of the image forming units 21, 22, 23 and 24 includes a developing device 21A, 22A, 23A and 24A and a photoconductor 21B, 22B, 23B and 24B, respectively. Each developing device 21A, 22A, 23A and 24A stores toner of one color. For example, C (cyan), M (magenta), Y (yellow) and BK (black) toner is stored in the developing devices 21A, 22A, 23A and 24A, respectively.

An exposure device 31 is arranged at a position opposite to the photoconductors 21B, 22B, 23B and 24B. The exposure device 31 forms an electrostatic image corresponding to a color to be developed on the photoconductors 21B, 22B, 23B and 24B. The toner is selectively supplied by the developing devices 21A, 22A, 23A and 24A to the photoconductors 21B, 22B, 23B and 24B. In this way, the electrostatic images on the surfaces of the photoconductors 21B, 22B, 23B and 24B are developed with toner. As a result, toner images are formed on the surface of the photoconductors 21B, 22B, 23B and 24B.

Opposing rollers 41, 42, 43 and 44 are arranged at positions opposite to the photoconductors 21B, 22B, 23B and 24B across the intermediate transfer belt 11. Each of the opposing rollers 41, 42, 43 and 44 presses the intermediate transfer belt 11 against the photoconductors 21B, 22B, 23B and 24B. In this way, the toner images formed on the photoconductors 21B, 22B, 23B and 24B are transferred to the intermediate transfer belt 11. The toner images on the surfaces of the photoconductors 21B, 22B, 23B and 24B are sequentially transferred to the intermediate transfer belt 11 at a given timing. The toner image of each color is formed on the intermediate transfer belt 11 through the transfer. The toner image of each color may overlap at a given position of the surface of the intermediate transfer belt 11, according to the image information.

At the transfer position 5A arranged on the conveyance path 5 is arranged a transfer driven roller 52 which is contacted with the intermediate transfer belt 11 at a given pressure. The transfer driven roller 52 is pressed against the transfer driving roller 51 on an opposite side of the intermediate transfer belt 11.

A bias is applied between the transfer driving roller 51 and the transfer driven roller 52. In this way, the charged toner moves towards the transfer driven roller 52 from the intermediate transfer belt 11. Thus, the toner image of each color overlapped on the surface of the intermediate transfer belt 11 is transferred to the sheet S from the intermediate transfer belt 11 at the transfer position 5A.

In addition, when the transfer of the toner image to the sheet S is not required, the transfer driven roller 52 is moved to a retracting position by a roller releasing mechanism (not shown). The retracting position is set to a position where the transfer driven roller 52 does not contact the intermediate transfer belt 11.

The register roller pair 7 is arranged at a given position on the conveyance path 5 between the sheet housing section 4 and the transfer position 5A. The register roller pair 7 includes a register driving roller 71 and a register driven roller 72. The register driving roller 71 is rotated in a given direction. The register driven roller 72 is pressed against the register driving roller 71 at a given pressure by a pressure mechanism (not shown). The sheet S conveyed from the sheet housing section 4 passes through the register roller pair 7 and then enters the transfer position 5A. The register roller pair 7 adjusts the conveyance direction of the sheet S before the sheet S enters the transfer position 5A.

The sheet S conveyed from the sheet housing section 4 towards the transfer position 5A along the conveyance path 5 is temporarily stopped when abutting against the register roller pair 7. The sheet S may be inclined when being conveyed from the sheet housing section 4 along the conveyance path 5. The sides of the inclined sheet S are not consistent with the conveyance direction which is perpendicular to the rotation axis of the register roller pair 7. In other words, the straight line of the front end of the sheet S may not be parallel to the rotation axis of the register roller pair 7. The front end of the sheet S abuts against the register roller pair 7 so that the straight line of the front end of the sheet S becomes parallel to the rotation axis of the register roller pair 7. In this state, the register roller pair 7 nips the sheet S to correct the inclination of the sheet S in the conveyance direction.

The toner image is conveyed towards the transfer position 5A through the intermediate transfer belt 11. The register roller pair 7 is rotated again at the timing when the toner image reaches the transfer position 5A. The toner image is conveyed through the intermediate transfer belt 11 and reaches the transfer position 5A. The sheet S reaches the transfer position 5A at the timing when the toner image reaches the transfer position 5A. The sheet S is passed through the transfer position 5A to transfer the toner image to the sheet S.

The fixing device 6 applies heat and pressure to the toner image transferred to the sheet S. The toner image is fixed on the sheet S through the heat and pressure. The fixing device 6 includes a fixing driving roller 61 and a fixing driven roller 62. The fixing driving roller 61 rotates in a given direction. The fixing driven roller 62 is pressed against the fixing driving roller 61 at a given pressure by a pressure mechanism (not shown).

The sheet S on which the toner image is fixed by the fixing device 6 is guided to a sheet discharge section 1*a* along the conveyance path 5. The sheet discharge section 1*a* serves as one part of an exterior cover for covering the printer section 3. The sheet discharge section 1*a* is positioned between the scanner section 2 and the cover.

A branch point 8A is positioned at the downstream side of the fixing device 6 on the conveyance path 5. The branch point 8A guides the sheet S in a direction different from the sheet discharge section 1*a*. When printing is to be performed on both sides of the sheet S, the sheet S is temporarily discharged towards the sheet discharge section 1*a*. Then the sheet S is drawn into the printer section 3 again. The sheet S is then guided to the reversal unit 8 through the branch point 8A.

The reversal unit 8 conveys the sheet S along a conveyance path 81 in the reversal unit 8.

In the present embodiment, the upstream side of the flow of the sheet S conveyed on the conveyance path 81 is referred to as the upstream side of the conveyance path 81. The downstream side of the flow of the sheet S conveyed on the conveyance path 81 is referred to as the downstream side of the conveyance path 81.

The reversal unit 8 includes a reversal unit register roller pair 82. Similar to the register roller pair 7, the reversal unit register roller pair 82 temporarily stops the sheet conveyed on the conveyance path 81. In this way, the inclination of the sheet S is corrected. Further, the reversal unit register roller pair 82 restarts the conveyance of the sheet S at the timing when the toner image (corresponding to a second side of the sheet S) reaches the transfer position 5A. The sheet S conveyed from the reversal unit register roller pair 82 is merged with the conveyance path 5.

On the conveyance path 5, there is a position where the sheet S discharged from the reversal unit register roller pair 82 is merged with the conveyance path 5. The sheet S can also be inserted to the conveyance path 5 from a manual feeding tray 83 at the upstream side of the position where the sheet S is merged with the conveyance path 5. For example, a large-sized sheet S that cannot be stored in the sheet housing section 4 is inserted from the manual feeding tray 83. Specifically, a long sheet having a length in the conveyance direction of the conveyance path 5 four times as long as that of an A4-sized sheet can be inserted from the manual feeding tray 83.

Figure 2:
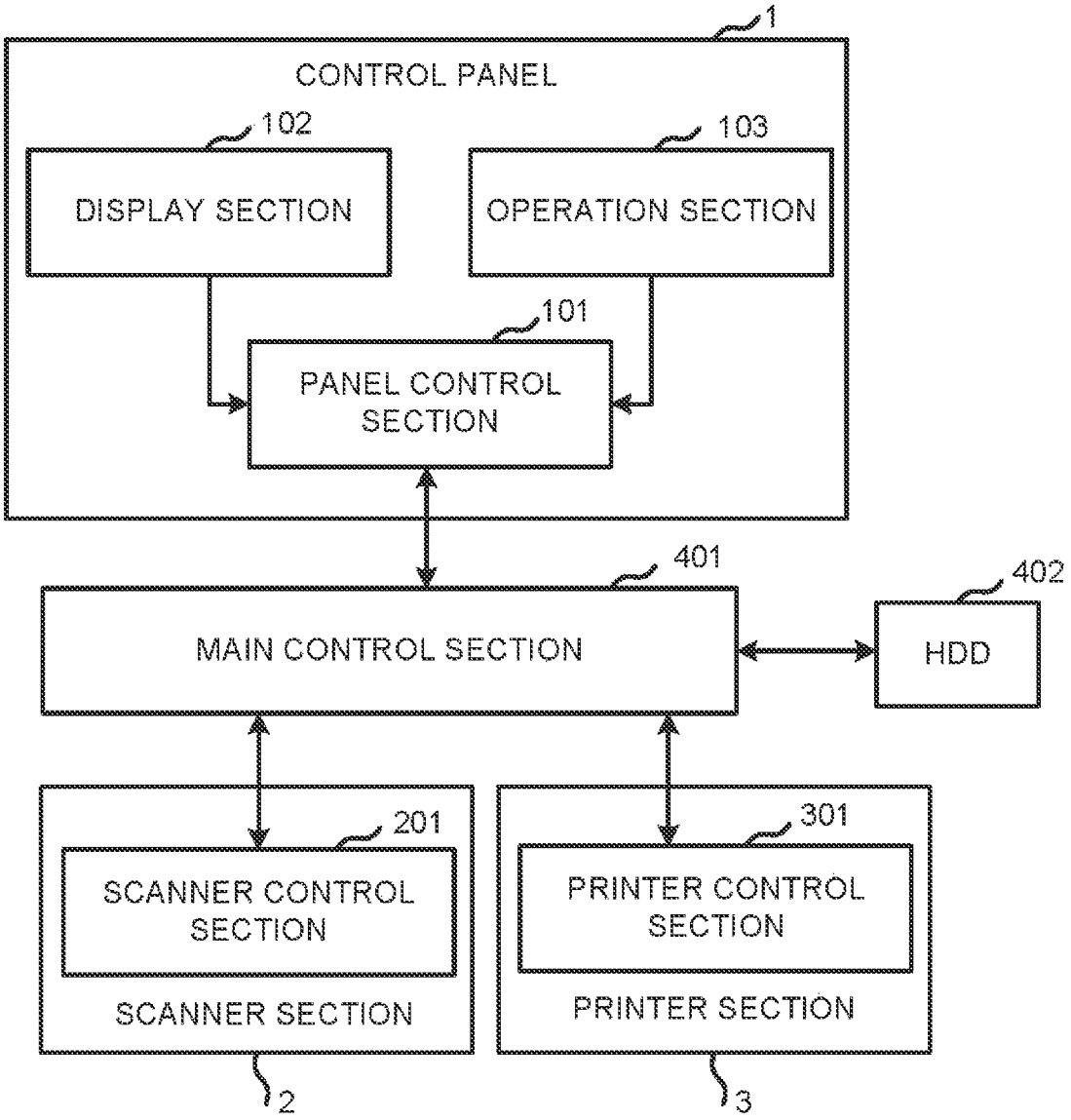
FIG. 2 is a block diagram illustrating an example configuration of the image forming apparatus.

Next, the image forming apparatus 100 is described with reference to FIG. 2. FIG. 2 is a block diagram illustrating an example configuration of the image forming apparatus 100.

A control panel 1 and the scanner section 2 and the printer section 3 described above are connected with a main control section 401. The main control section 401 controls the operations of the image forming apparatus 100. The main control section 401 is connected with an HDD (Hard Disk Drive) 402. The main control section 401 includes a CPU (Central Processing Unit), an ROM (read only memory) and an RAM (Random Access Memory).

The HDD 402, which is a memory such as a semiconductor storage device, a magnetic storage device and the like, stores programs and the like for the main control section 401.

The control panel 1 includes a panel control section 101, a display section 102 and an operation section 103. The panel control section 101, which includes a CPU, an ROM and an RAM, controls the control panel 1.

The display section 102 outputs a screen corresponding to the operation content or an image corresponding to an instruction from the main control section 401.

The operation section 103, which includes various keys, receives an operation from a user, and outputs a signal indicating the operation content to the panel control section 101.

The display section 102 and the operation section 103 may be integrally arranged as a touch panel type display.

In the present embodiment, the main control section 401 displays various settings such as the number of printings, the size and the category of the sheet S, and the like on the display section 102. The operation section 103 can receive a designation and a change of the setting. For example, information relating to the setting is displayed on the display section 102. For example, the information indicating the category of the sheet S can be designated through the operation section 103. The operation section 103 outputs the information indicating the designated category of the sheet S to a printer control section 301. The printer control section 301 writes the designated category of the sheet S in the RAM arranged inside.

The scanner section 2 is provided with a scanner control section 201. The scanner control section 201, which includes a CPU, an ROM and an RAM, controls the scanner section 2 to read image information.

The printer section 3 is provided with a printer control section 301. The printer control section 301, which includes a CPU, an ROM and an RAM, controls the printer section 3 to print an image on the sheet S.

Figure 3:
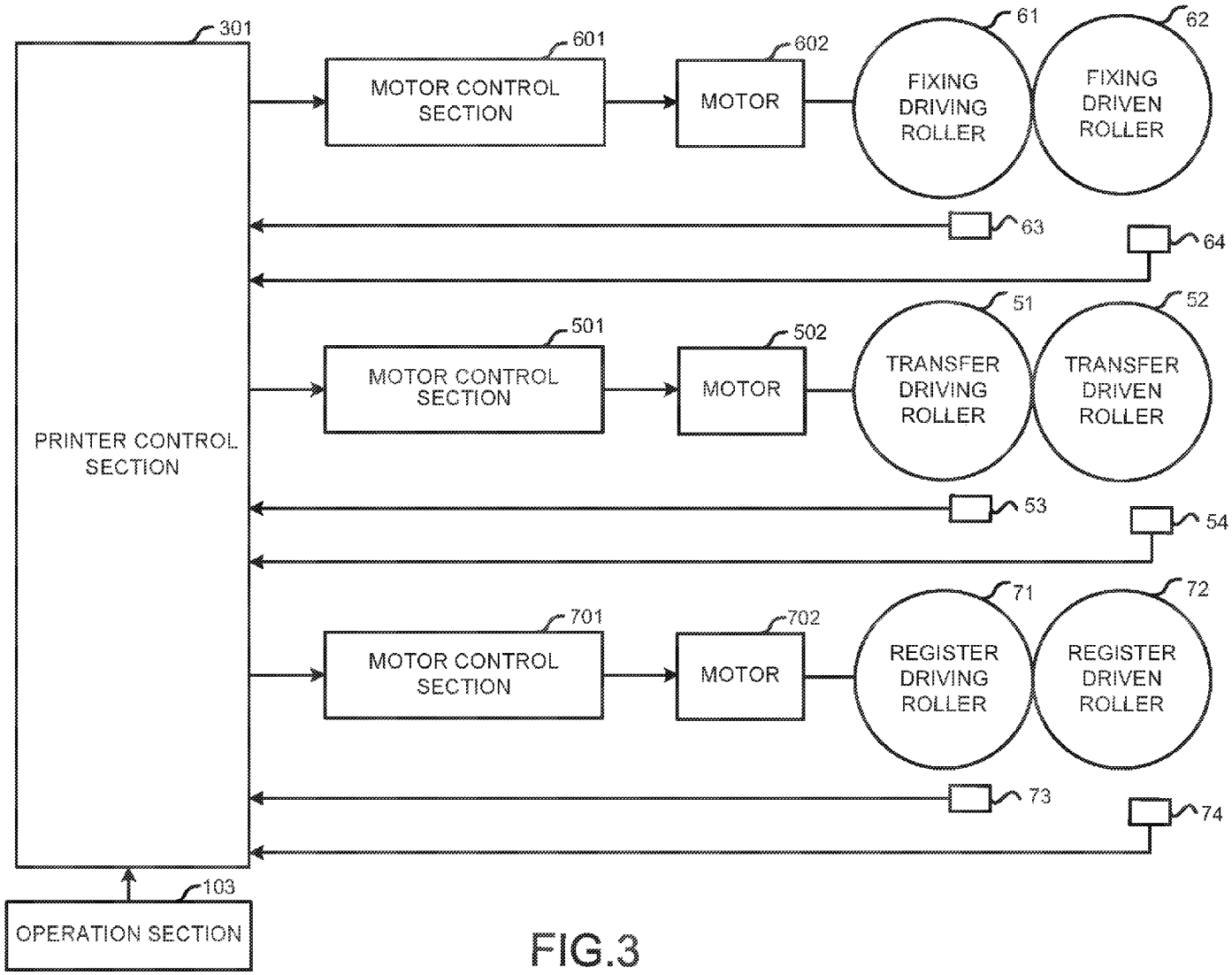
FIG. 3 is a block diagram illustrating an example configuration of one part of the image forming apparatus.

Next, one part of the image forming apparatus 100 is described in detail with reference to FIG. 3. FIG. 3 is a block diagram illustrating an example configuration of one part of the image forming apparatus 100.

As shown in FIG. 3, the fixing driving roller 61 is connected with a motor 602. The motor 602 is connected with a motor control section 601. The motor control section 601 is connected with the printer control section 301. The motor control section 601 rotates the motor 602 at a designated rotation speed. The rotation speed is designated and controlled through the printer control section 301. The fixing driving roller 61 is rotated along with the rotation of the motor 602. The movement of the fixing driving roller 61 is transmitted to the fixing driven roller 62. Thus, the fixing driven roller 62 rotates in a direction opposite to that of the fixing driving roller 61.

A speed sensor 63 is arranged nearby the roller surface of the fixing driving roller 61 to measure the rotation speed of the fixing driving roller 61. A speed sensor 64 is arranged nearby the roller surface of the fixing driven roller 62 to measure the rotation speed of the fixing driven roller 62. The speed sensors 63 and 64 output signals indicating the detection results to the printer control section 301.

The transfer driving roller 51 is connected with a motor 502. The motor 502 is connected with a motor control section 501. The motor control section 501 is connected with the printer control section 301. The motor control section 501 rotates the motor 502 at a designated rotation speed. The rotation speed is designated and controlled through the printer control section 301. The transfer driving roller 51 is rotated along with the rotation of the motor 502. The movement of the transfer driving roller 51 is transmitted to the transfer driven roller 52. Thus, the transfer driven roller 52 rotates in a direction opposite to that of the transfer driving roller 51.

A speed sensor 53 is arranged nearby the roller surface of the transfer driving roller 51 to measure the rotation speed of the transfer driving roller 51. A speed sensor 54 is arranged nearby the roller surface of the transfer driven roller 52 to measure the rotation speed of the transfer driven roller 52. The speed sensors 53 and 54 output signals indicating the detection results to the printer control section 301.

The register driving roller 71 is connected with a motor 702. The motor 702 is connected with a motor control section 701. The motor control section 701 is connected with the printer control section 301. The motor control section 701 rotates the motor 702 at a designated rotation speed. The rotation speed is designated and controlled through the printer control section 301. The register driving roller 71 is rotated along with the rotation of the motor 702. The movement of the register driving roller 71 is transmitted to the register driven roller 72. Thus, the register driven roller 72 rotates in a direction opposite to that of the register driving roller 71.

A speed sensor 73 is arranged nearby the roller surface of the register driving roller 71 to measure the rotation speed of the register driving roller 71. A speed sensor 74 is arranged nearby the roller surface of the register driven roller 72 to measure the rotation speed of the register driven roller 72. The speed sensors 73 and 74 output signals indicating detection results to the printer control section 301.

Figure 4:
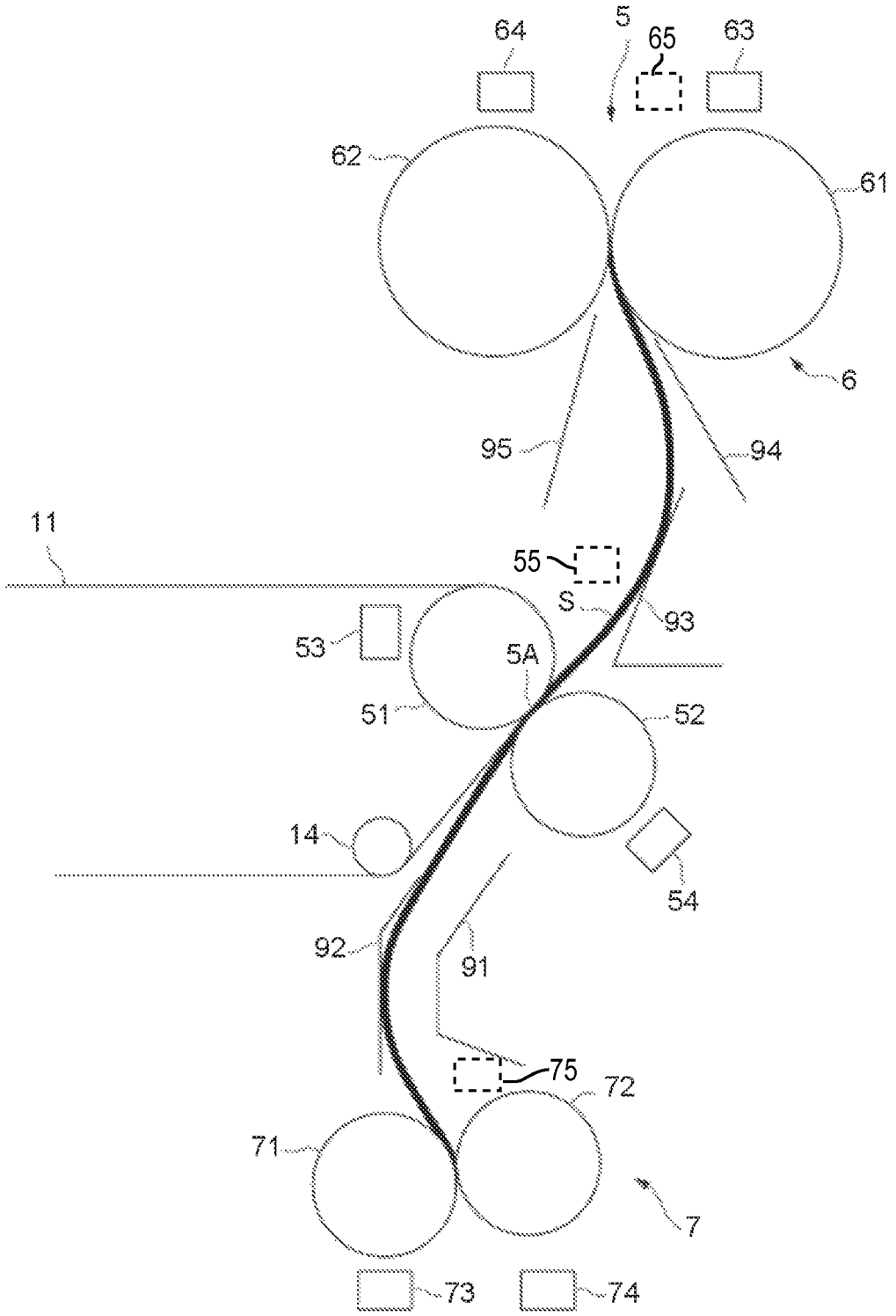
FIG. 4 is a schematic diagram illustrating a part of the image forming apparatus nearby a transfer position.

Next, the arrangement nearby the transfer position 5A in the image forming apparatus 100 is described with reference to FIG. 4. FIG. 4 is a block diagram illustrating part of the image forming apparatus 100 nearby the transfer position 5A.

The sheet S shown in FIG. 4 is in a state of being conveyed on the conveyance path 5. In the example shown in FIG. 4, the sheet S is positioned on the conveyance path 5 and extends from the register roller pair 7 to the fixing device 6.

A guide 91 and a guide 92 are positioned on the conveyance path 5 between the register roller pair 7 and the transfer position 5A to regulate the bulge of the sheet S. The guide 91 is positioned at the right side of the conveyance path 5 in FIG. 4, and the guide 92 is positioned at the left side of the conveyance path 5 in FIG. 4.

A guide 93, a guide 94 and a guide 95 are positioned on the conveyance path 5 between the transfer position 5A to the fixing device 6 to regulate the bulge of the sheet S. The guide 93 is arranged at the upstream side of the guide 94. The guide 93 and the guide 94 are arranged at the right side of the conveyance path 5 in FIG. 4. The guide 95 is arranged at the left side of the conveyance path 5 in FIG. 4.

In the following description, the deflection amount of the sheet S (which is nipped by the register roller pair 7 and is nipped by the intermediate transfer belt 11 and the transfer driven roller 52) is referred to as a deflection amount C1. The deflection amount C1 is controlled to be smaller than an upper limit value A and greater than a lower limit value B, i.e., in a range B≤C1≤A. The upper limit value A and the lower limit value B can be set to any value through the operation section 103 or a communication module. The upper limit value A and the lower limit value B are stored in an RAM in the printer control section 301.

When the deflection amount C1 is greater than the upper limit value A, there is a possibility that the charge of the sheet S applied with the bias between the transfer driving roller 51 and the transfer driven roller 52 is not uniform. In this case, the toner image cannot be transferred uniformly, which may lead to a decrease in the quality of the resulting image.

On the other hand, when the deflection amount C1 is smaller than the lower limit value B, there is a possibility that the sheet S cannot enter the transfer position 5A smoothly due to the insufficient deflection of the sheet S. In this case, as stated above, there is a possibility that the charge of the sheet S is not uniform. Further, the transfer position of the toner image may be deviated, which may lead to a decrease in the quality of the image.

In the following description, the deflection amount of the sheet S which is nipped by the intermediate transfer belt 11 and the transfer driven roller 52 and is nipped by the fixing device 6 is referred to as a deflection amount C2. The deflection amount C2 is controlled to be smaller than an upper limit value D and greater than a lower limit value E, i.e., in a range E≤C2≤D. The upper limit value D and the lower limit value E can be set to any value through the operation section 103 or a communication module. The upper limit value D and the lower limit value E are stored in the RAM in the printer control section 301.

When the deflection amount C2 is greater than the upper limit value D, the sheet S bulges towards the guide 95. Then the surface of the sheet S on which the toner image is printed may contact with the guide 95. In this case, part of the toner image may be scraped or peeled off from the sheet S, which may lead to a decrease in the quality of the image formed on the sheet S.

On the other hand, when the deflection amount C2 is smaller than the lower limit value E, the deflection of the sheet S is insufficient, which may lead to a large variation in the conveyance track of the sheet S. In this case, a load may be applied to the surface of the sheet S, and part of the toner image is peeled off from the sheet S, which may lead to a decrease in the quality of the image formed on the sheet S.

Figure 5:
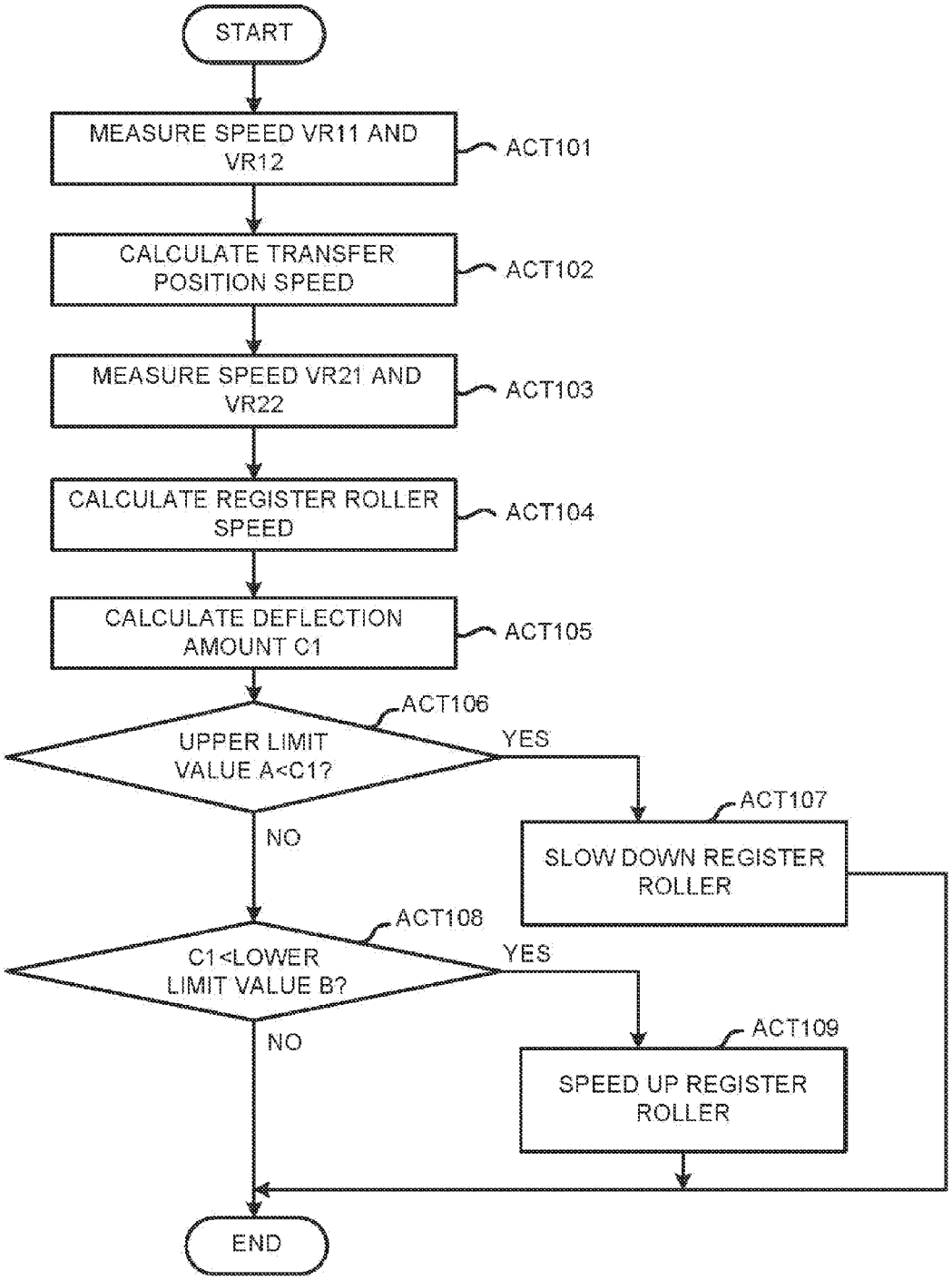
FIG. 5 is a flowchart illustrating an example sequence of operations performed in the image forming apparatus.

Next, part of the processing carried out in the image forming apparatus 100 is described with reference to FIG. 5. FIG. 5 is a flowchart illustrating an example sequence of operations performed in the image forming apparatus 100. The image forming apparatus 100 repeatedly executes the processing shown in FIG. 5.

The speed sensor 53 measures a rotation speed Vr11 of the transfer driving roller 51. The speed sensor 54 measures a rotation speed Vr12 of the transfer driven roller 52 (ACT 101).

The printer control section 301 calculates a transfer position speed Vp1 based on the rotation speed Vr11 from the speed sensor 53 and the rotation speed Vr12 from the speed sensor 54 (ACT 102). The transfer position speed Vp1 refers to the speed of the sheet S conveyed by the intermediate transfer belt 11 and the transfer driven roller 52 at the transfer position 5A. In other words, the transfer position speed Vp1 is the conveyance speed of the sheet S passing through the transfer position 5A.

For example, the printer control section 301 may calculate the transfer position speed Vp1 according to the following formula (1).

$$Vp1=(Vr11+Vr12)/2 \quad \text{Formula (1):}$$

Next, the speed sensor 73 measures a rotation speed Vr21 of the register driving roller 71. The speed sensor 74 measures a rotation speed Vr22 of the register driven roller 72 (ACT 103).

The printer control section 301 calculates a register roller speed Vp2 based on the rotation speed Vr21 from the speed sensor 73 and the rotation speed Vr22 from the speed sensor 74 (ACT 104). The register roller speed Vp2 refers to the speed of the sheet S conveyed by the register roller pair 7. In other words, the register roller speed Vp2 is the conveyance speed of the sheet S passing through the nip position of the register roller pair 7.

For example, the printer control section 301 may calculate the register roller speed Vp2 according to the following formula (2).

$$Vp2=(Vr21+Vr22)/2 \quad \text{Formula (2):}$$

Next, the printer control section 301 calculates the deflection amount C1 based on the transfer position speed Vp1 and the register roller speed Vp2 (ACT 105).

For example, the printer control section 301 may calculate the deflection amount C1 according to the following formula (3).

$$C1=(Vp2-Vp1)*((L-11)/Vp2) \quad \text{Formula (3):}$$

The "L" refers to the length of the paper in the conveyance direction on the conveyance path 5. The "11" refers to the distance between the nip position of the register roller pair 7 and the transfer position 5A.

The printer control section 301 acquires the length L of the paper based on the size of the paper. For example, the size of the paper is designated through the operation section 103. The printer control section 301 may also acquire the length L of the paper based on the direction of the sheet S stored in the sheet housing section 4, in addition to the size of the paper. In addition, the size of the paper is not limited to the information designated through the operation section 103. The size of the paper most often used may be designated in advance. The information indicating the pre-designated size of the paper is stored in the RAM in the printer control section 301. In this case, the printer control section 301 reads the pre-designated size of the paper from the internal RAM if there is no size-change instruction from the operation section 103.

Next, printer control section 301 determines whether or not the deflection amount C1 is greater than the upper limit value A (ACT 106).

If the deflection amount C1 is greater than the upper limit value A (YES in ACT 106), the printer control section 301 controls the motor control section 701 to decrease the rotation speed of the register driving roller 71 (ACT 107). In this way, the conveyance speed of the sheet S by the register roller pair 7 at the upstream side is decreased. Thus, the deflection amount between the register roller pair 7 and the transfer position 5A is reduced.

On the other hand, if the deflection amount C1 is not greater than the upper limit value A (NO in ACT 106), the printer control section 301 determines whether or not the deflection amount C1 is smaller than the lower limit value B (ACT 108).

If the deflection amount C1 is smaller than the lower limit value B (YES in ACT 108), the printer control section 301 controls the motor control section 701 to increase the rotation speed of the register driving roller 71 (ACT 109). In this way, the conveyance speed of the sheet S by the register roller pair 7 at the upstream side is increased. Thus, the deflection amount between the register roller pair 7 and the transfer position 5A is increased.

If the deflection amount C1 is not smaller than the lower limit value B (NO in ACT 108), the printer control section 301 terminates the processing, that is, the motor control section 701 maintains the rotation speed of the register driving roller 71.

Figure 6:
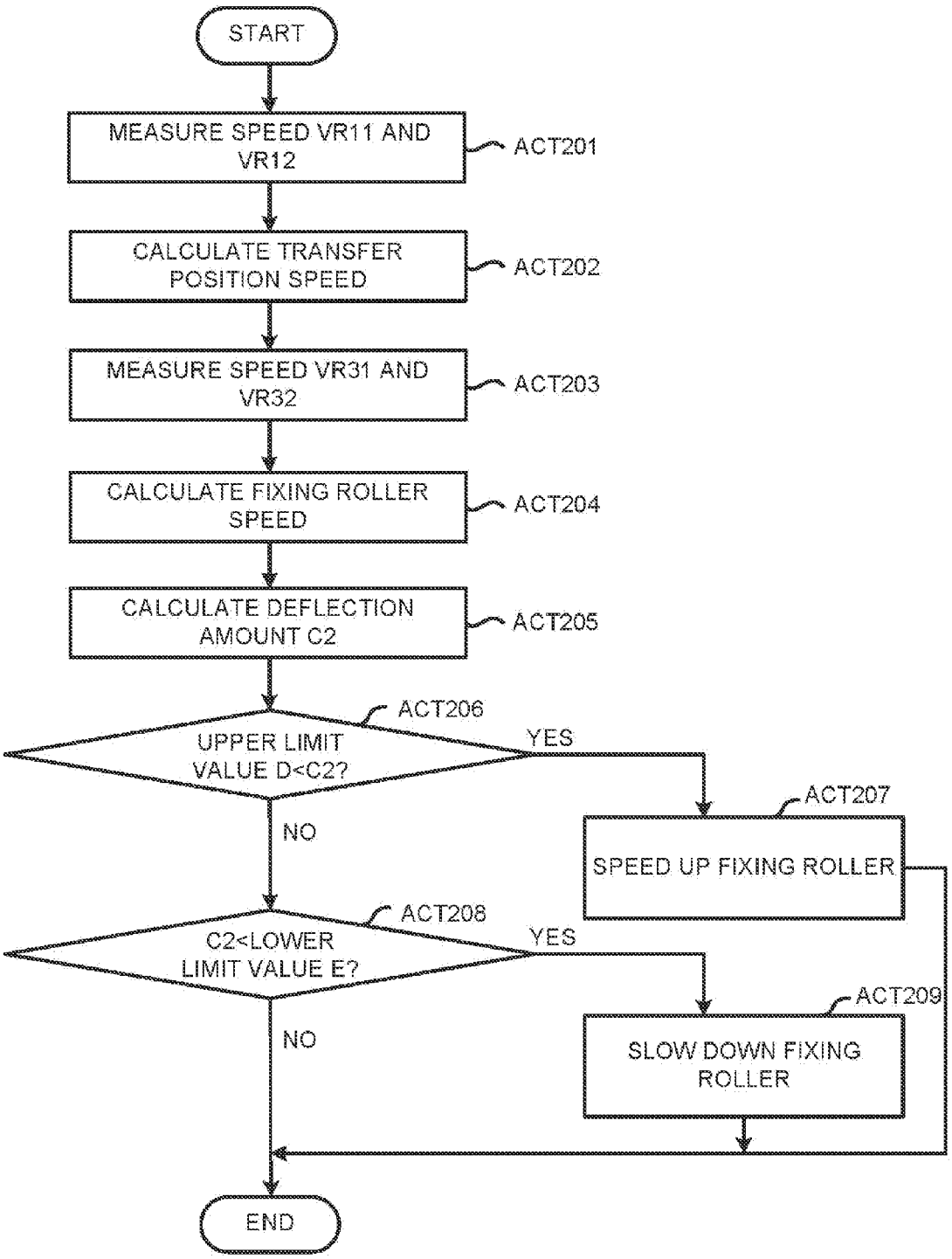
FIG. 6 is a flowchart illustrating another example sequence of operations performed in the image forming apparatus.

Next, part of other processing carried out in the image forming apparatus 100 is described with reference to FIG. 6. FIG. 6 is a flowchart illustrating another example sequence of operations performed in the image forming apparatus 100. The image forming apparatus 100 repeatedly executes the processing shown in FIG. 6.

The speed sensor 53 measures a rotation speed Vr11 of the transfer driving roller 51. The speed sensor 54 measures a rotation speed Vr12 of the transfer driven roller 52 (ACT 201).

The printer control section 301 calculates a transfer position speed Vp1 based on the rotation speed Vr11 from the speed sensor 53 and the rotation speed Vr12 from the speed sensor 54 (ACT 202).

For example, the printer control section 301 may calculate the transfer position speed Vp1 according to the formula (1) described above.

Next, speed sensor 63 measures a rotation speed Vr31 of the fixing driving roller 61. The speed sensor 64 measures a rotation speed Vr32 of the fixing driven roller 62 (ACT 203).

The printer control section 301 calculates a fixing roller speed Vp3 based on the rotation speed Vr31 from the speed sensor 63 and the rotation speed Vr32 from the speed sensor 64 (ACT 204). The fixing roller speed Vp3 refers to the speed of the sheet S conveyed by the fixing driving roller 61 and the fixing driven roller 62 in the fixing device 6. In other words, the fixing roller speed Vp3 is the conveyance speed of the sheet S passing through the nip position of the fixing device 6.

For example, the printer control section 301 may calculate the fixing roller speed Vp3 according to the following formula (4).

$$Vp3=(Vr31+Vr32)/2 \quad \text{Formula (4):}$$

Next, the printer control section 301 calculates the deflection amount C2 based on the transfer position speed Vp1 and the fixing roller speed Vp3 (ACT 205).

For example, the printer control section 301 may calculate the deflection amount C2 according to the following formula (5).

$$C2=(Vp1-Vp3)*((L-12)/Vp1) \quad \text{Formula (5):}$$

In formula (5), "12" refers to the distance between the roller nip position of the fixing device 6 and the transfer position 5A. The roller nip position of the fixing device 6 refers to the position of the nip between the fixing driving roller 61 and the fixing driven roller 62.

Then the printer control section 301 determines whether or not the deflection amount C2 is greater than the upper limit value D (ACT 206).

If the deflection amount C2 is greater than the upper limit value D (YES in ACT 206), the printer control section 301 instructs the motor control section 601 to increase the rotation speed of the fixing driving roller 61 (ACT 207). In this way, the conveyance speed of the sheet S by the fixing device 6 at the downstream side is increased. Thus, the deflection amount between the transfer position 5A and the fixing device 6 is reduced.

On the other hand, if the deflection amount C2 is not greater than the upper limit value D (NO in ACT 206), the printer control section 301 determines whether or not the deflection amount C2 is smaller than the lower limit value E (ACT 208).

If the deflection amount C2 is smaller than the lower limit value E (YES in ACT 208), the printer control section 301 instructs the motor control section 601 to decrease the rotation speed of the fixing driving roller 61 (ACT 209). In this way, the conveyance speed of the sheet S by the fixing device 6 at the downstream side is decreased. Thus, the deflection amount between the transfer position 5A and the fixing device 6 is increased.

If the deflection amount C2 is not smaller than the lower limit value E (NO in ACT 208), the printer control section 301 terminates the processing.

As stated above, the image forming apparatus 100 according to the present embodiment calculates the deflection amount of the sheet S based on the conveyance speed of the sheet S. The image forming apparatus 100 controls, based on the calculated deflection amount, the rotation speed of at least one of the roller at the upstream side and the roller at the downstream side. The roller at the upstream side and the roller at the downstream side refer to rollers that nip the sheet S at the same time. With such an arrangement, the image forming apparatus 100 can adjust the conveyance speed of the sheet S in response to the variation of the deflection amount. Thus, the image forming apparatus 100 can compensate excess and deficiency of deflection amount when the deflection amount is changed.

The image forming apparatus 100 according to the embodiment may calculate the conveyance speed of the sheet S based on the rotation speed of the transfer driving roller 51 and the rotation speed of the transfer driven roller 52. The calculated conveyance speed of the sheet S refers to the conveyance speed of the sheet S passing through the transfer position 5A.

The image forming apparatus 100 according to the embodiment may calculate the conveyance speed of the sheet S passing through the fixing device 6 based on the rotation speed of the fixing driving roller 61 and the rotation speed of the fixing driven roller 62. The calculated conveyance speed of the sheet S refers to the conveyance speed of the sheet S passing through the fixing device 6.

The image forming apparatus 100 according to the embodiment may calculate the conveyance speed of the sheet S based on the rotation speed of the register driving roller 71 and the rotation speed of the register driven roller 72. The calculated conveyance speed of the sheet S refers to the conveyance speed of the sheet S passing through the register roller pair 7. With such an arrangement, the conveyance speed of the sheet S can be calculated without depending on the tolerance of each roller. Thus, the deflection amount of the sheet S can be calculated more accurately.

The image forming apparatus 100 according to the embodiment controls the rotation speed of the transfer driving roller 51 to a constant speed. In other words, the image forming apparatus 100 only adjusts the rotation speed of the register driving roller 71 in a case of adjusting the deflection amount C1. The image forming apparatus 100 only adjusts the rotation speed of the fixing driving roller 61 in a case of adjusting the deflection amount C2. With such an arrangement, the conveyance speed of the sheet S passing through the transfer position 5A can be maintained at a constant value, which can stabilize the transfer state.

The image forming apparatus 100 may control the rotation speed according to the length of the sheet S in the conveyance direction of the conveyance path 5. For example, the printer control section 301 may control the rotation speed of the register driving roller 71 to be slower when conveying a paper of which the length in the conveyance direction is long compared to conveying an A4-sized paper of which the length in the conveyance direction is short. Similarly, the printer control section 301 may control the rotation speed of the fixing driving roller 61 to be slower when conveying a long paper of which the length in the conveyance direction is long compared to conveying an A4-sized paper of which the length in the conveyance direction is short.

In a case in which the deflection amount is greater than the upper limit value, the image forming apparatus 100 according to the embodiment decreases the rotation speed of the roller at the upstream side or increases the rotation speed of the roller at the downstream side. For example, in a case in which the deflection amount C1 is greater than the upper limit value A, the rotation speed of the register driving roller 71 is decreased. For example, in a case in which the deflection amount C2 is greater than the upper limit value D, the rotation speed of the fixing driving roller 61 is increased. With such an arrangement, the deflection amounts C1 and C2 are reduced. Thus, the deflection amount C1 may be maintained in a predetermined range.

In a case in which the deflection amount is smaller than the lower limit value, the image forming apparatus 100 according to the embodiment increases the rotation speed of the roller at the upstream side or decreases the rotation speed of the roller at the downstream side. For example, in a case in which the deflection amount C1 is smaller than the lower limit value B, the rotation speed of the register driving roller 71 is increased. For example, in a case in which the deflection amount C2 is smaller than the lower limit value E, the rotation speed of the fixing driving roller 61 is decreased. With such an arrangement, the deflection amounts C1 and C2 are increased. Thus, the deflection amount C1 may be maintained in a predetermined range.

The image forming apparatus 100 according to the embodiment controls the rotation speed of the roller at the downstream side in such a range that the rotation speed of the roller at the downstream side does not exceed the rotation speed of the roller at the upstream side. The image forming apparatus 100 according to the embodiment controls the rotation speed of the roller at the upstream side in such a range that the rotation speed of the roller at the upstream side is not slower than the rotation speed of the roller at the downstream side. With such an arrangement, the rotation speed of the roller at the upstream side can be controlled to be faster than the rotation speed of the roller at the downstream side. Thus, the image forming apparatus 100 can convey the sheet S in a deflected state.

In addition, though the image forming apparatus 100 which fixes the toner image on the sheet is exemplified, an inkjet type image forming apparatus can also be used.

Further, a speed sensor for detecting the conveyance speed of the sheet S may be used instead of the speed sensor which detects the rotation speed of the surface of the roller.

For example, a speed sensor 75 (shown with broken lines in FIG. 4) may be arranged at the downstream side of the register roller pair 7. The speed sensor 75 detects the speed of the sheet S which is just discharged from the nip position of the register roller pair 7.

A speed sensor 55 (shown with broken lines in FIG. 4) may be arranged at the downstream side of the transfer position 5A. The speed sensor 55 detects the speed of the sheet S which is just discharged from the nip position between the intermediate transfer belt 11 and the transfer driven roller 52.

A speed sensor 65 (shown with broken lines in FIG. 4) may be arranged at the downstream side of the fixing device 6. The speed sensor 65 detects the speed of the sheet S which is just discharged from the nip position between the fixing driving roller 61 and the fixing driven roller 62.

In the foregoing description, though the register roller pair 7 is taken as the rotation speed adjustment target, the present invention is not limited to this. For example, the rotation speed of the reversal unit register roller pair 82 of the reversal unit 8 may be adjusted instead.

Moreover, the size and the position of each roller can be changed as needed according to design considerations.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a first roller arranged on a conveyance path of a sheet;

a second roller arranged downstream of the first roller in the conveyance path;

a first speed sensor configured to measure a speed of a surface of the first roller;

a second speed sensor configured to measure a speed of a surface of the second roller; and a control section configured to:

calculate a conveyance speed of the sheet conveyed along the conveyance path based on the speed measured by the first speed sensor and the speed measured by the second speed sensor, calculate a deflection amount of the sheet nipped by the first roller and the second roller based on the calculated conveyance speed of the sheet conveyed along the conveyance path, and control a rotation speed of at least one of the first roller and the second roller based on the calculated deflection amount, wherein the control section increases the rotation speed of the first roller and decreases the rotation speed of the second roller when the deflection amount is smaller than a predetermined lower limit value.

2. The image forming apparatus according to claim 1, wherein the control section controls the rotation speed of either the first roller or the second roller to be constant.

3. The image forming apparatus according to claim 1, wherein the first roller is a transfer roller for transferring a toner image to the sheet; and the second roller is a fixing roller for fixing the toner image on the sheet.

4. The image forming apparatus according to claim 1, wherein the first roller is a register roller for adjusting the conveyance direction of the sheet before the sheet enters a transfer position on the conveyance path; and the second roller is a transfer roller for transferring a toner image to the sheet at the transfer position.

5. An image forming apparatus, comprising:

a register roller arranged on a conveyance path of a sheet;

a transfer roller arranged downstream of the register roller in the conveyance path;

a fixing roller arranged downstream of the transfer roller in the conveyance path;

a first speed sensor configured to measure a speed of a surface of the register roller;

a second speed sensor configured to measure a speed of a surface of the transfer roller;

a third speed sensor configured to measure a speed of a surface of the fixing roller; and a control section configured to:

calculate the conveyance speed of the sheet between the register roller and the transfer roller based on the speeds measured by the first and second speed sensors, calculate the conveyance speed of the sheet between the transfer roller and the fixing roller based on the speeds measured by the second and third speed sensors, calculate a deflection amount of the sheet nipped by two of the register, transfer, and fixing rollers based on a conveyance speed of the sheet conveyed along the conveyance path between the two rollers, and control a rotation speed of at least one of the two rollers based on the calculated deflection amount.

6. The image forming apparatus according to claim 5, wherein the control section controls the rotation speed of either of the two rollers to be constant.

7. The image forming apparatus according to claim 5, wherein the control section decreases the rotation speed of the register roller and increases the rotation speed of the transfer roller when a deflection amount of the sheet nipped by the register and transfer rollers is greater than a predetermined upper limit value.

8. The image forming apparatus according to claim 5, wherein the control section decreases the rotation speed of the transfer roller and increases the rotation speed of the fixing roller when a deflection amount of the sheet nipped by the transfer and fixing rollers is greater than a predetermined upper limit value.

9. The image forming apparatus according to claim 5, wherein the control section increases the rotation speed of the register roller and decreases the rotation speed of the transfer roller when a deflection amount of the sheet nipped by the register and transfer rollers is smaller than a predetermined lower limit value.

10. The image forming apparatus according to claim 5, wherein the control section increases the rotation speed of the transfer roller and decreases the rotation speed of the fixing roller when a deflection amount of the sheet nipped by the transfer and fixing rollers is smaller than a predetermined lower limit value.

11. A method of controlling rotation speeds of a register roller, a transfer roller, and a fixing roller of an image forming apparatus, wherein the transfer roller is arranged downstream of the register roller along a sheet conveyance path and the fixing roller is arranged downstream of the register roller along a sheet conveyance path, the method comprising:

calculating a deflection amount of the sheet nipped by two of the register, transfer, and fixing rollers based on a conveyance speed of the sheet conveyed along the conveyance path between the two rollers;

decreasing a rotation speed of the register roller and increasing a rotation speed of the transfer roller when a deflection amount of the sheet nipped by the register and transfer rollers is greater than a first value;

decreasing the rotation speed of the transfer roller and increasing a rotation speed of the fixing roller when a deflection amount of the sheet nipped by the transfer and fixing rollers is greater than a second value;

increasing the rotation speed of the register roller and decreasing the rotation speed of the transfer roller when the deflection amount of the sheet nipped by the register and transfer rollers is smaller than a third value; and increasing the rotation speed of the transfer roller and decreasing the rotation speed of the fixing roller when the deflection amount of the sheet nipped by the transfer and fixing rollers is smaller than a fourth value.

* * * * *